US005502548A

United States Patent [19]

Suzuki et al.

[11] Patent Number: 5,502,548

[45] Date of Patent: Mar. 26, 1996

[54] CONTACT-TYPE CHARGING MEMBER WHICH INCLUDES AN INSULATING METAL OXIDE IN A SURFACE LAYER THEREOF

[75] Inventors: Yasuyuki Suzuki, Saitama; Takashi Yamashita, Toride, both of Japan

[73] Assignee: Canon Kabushiki Kaisha, Tokyo, Japan

[21] Appl. No.: 405,407

[22] Filed: Mar. 15, 1995

Related U.S. Application Data

[63] Continuation of Ser. No. 145,133, Nov. 3, 1993, abandoned.

[30] Foreign Application Priority Data

Nov. 4, 1992 [JP] Japan ..... 4-295136

[51] Int. Cl.[6] ..... G03G 15/02

[52] U.S. Cl. ..... 355/219; 361/225

[58] Field of Search ..... 355/219, 271; 361/225; 340/35, 902

[56] References Cited

U.S. PATENT DOCUMENTS 4,371,252 2/1983 Uchida et al. ..... 361/225 X 5,112,708 5/1992 Okunuki et al. ..... 361/225 X

FOREIGN PATENT DOCUMENTS 0308185 3/1989 European Pat. Off. .

0329366 8/1989 European Pat. Off. .

0534437 3/1993 European Pat. Off. .

*Primary Examiner*—R. L. Moses

*Attorney, Agent, or Firm*—Fitzpatrick, Cella, Harper & Scinto

[57] ABSTRACT

A charging member for use in a contact charging device which charges a charge-receiving member such as a photosensitive drum in a copier or printer by applying a voltage to the charging member and contacting the charging member to the charge-receiving member. The charging member includes at least an elastic layer and a surface layer disposed thereon which contacts the charge-receiving member. The surface layer includes at least a semiconductive resin and an insulating metal oxide contained in the semiconductive resin, and the surface layer has a maximum height of surface roughness (Rmax) of 10 μm to 100 μm.

19 Claims, 3 Drawing Sheets

CONTACT-TYPE CHARGING MEMBER WHICH INCLUDES AN INSULATING METAL OXIDE IN A SURFACE LAYER THEREOF

This application is a continuation of application Ser. No. 08/145,133 filed Nov. 3, 1993, now abandoned.

FIELD OF THE INVENTION AND RELATED ART

The present invention relates to a charging member for use in a contact charging device, an electrophotographic apparatus, etc. More specifically, the present invention relates to a charging member, a contact charging device using the charging member for charging a charge-receiving member through steps of: applying a voltage to the charging member and disposing the charging member being in contact with the charge-receiving member, a device unit using the charging member, and an electrophotographic apparatus using the charging member.

In an image forming apparatus including an electrophotographic apparatus (such as a copying machine or a laser beam printer) and an electrostatic recording apparatus, heretofore, a corona discharge device has widely been used as means for performing charging treatment against the surface of an image-carrying member as a charge-receiving member including a photosensitive member, a dielectric material, etc. Such a corona discharge device is an effective means for uniformly charging the surface of a charge-receiving member such as an image-carrying member so as to have a desired potential level.

However, the corona charging device is required to have a high-voltage power supply and utilizes corona discharge, thus encountering a problem such as occurrence of ozone.

In contrast to such a corona discharge device, a contact charging device as mentioned above has the advantages of a decrease in an applied voltage provided by a power supply, a decrease in an amount of generated ozone, etc.

A charging member for use in such a contact charging device may generally be constituted by disposing an electroconductive elastic layer and a resistance layer on an electroconductive support. Further, a surface layer may be formed on the resistance layer. The electroconductive elastic layer may be used as a base layer and the resistance layer may be used as a layer for controlling a resistance and improving a withstand voltage characteristic. The surface layer (including the resistance layer in some cases) of the charging member may generally be formed by dispersing or dissolving a mixture of a rubber (or a resin) and an electroconductive filler such as electroconductive carbon or electroconductive metal oxide in an appropriate organic solvent to prepare a coating liquid, applying the coating liquid onto the surface of na under layer (e.g., a base layer), and drying the resultant coating to evaporate the organic solvent. In this instance, however, the electroconductive filler causes aggregation or agglomeration in some cases due to poor dispersibility of the filler because electroconductive carbon or electroconductive metal oxide is used. As a result, the resultant charging member causes leakage. In addition, the charging member causes a pinhole at the aggregation part thereof due to a dielectric breakdown.

In order to perform a uniform charging, a charging roller is required to have a uniform electrical resistance in the longitudinal direction (or longer direction) of the roller at a nip part between the roller and a charge-receiving member (hereinbelow, such a direction is referred to as "nip direction"). When an under layer of a charging roller is caused to have the nip direction due to a difference in a stress at the time of shaping, a surface layer is also cause to have an ununiform electrical resistance similar to that of the under layer even if the surface layer is formed by using a conductive filler. As a result, an image failure such as fogs is liable to occur in a resultant image due to a high electrical resistance part of the surface layer.

SUMMARY OF THE INVENTION

An object of the present invention is to provide a charging member causing no leakage even if a metal oxide contained in a surface resin agglomerates or aggregates.

Another object of the present invention is to provide a charging member showing no ununiformity in a resistance with respect to a nip direction.

A further object of the present invention is to provide an electrophotographic apparatus using such charging members.

According to the present invention, there is provided a charging member for use in a contact charging device for charging a charge-receiving member through steps of: applying a voltage to the charging member and disposing the charging member being in contact with the charge-receiving member, comprising:

at least an elastic layer and a surface layer disposed thereon contacting the charge-receiving member; wherein the surface layer comprises at least a semiconductive resin and an insulating metal oxide contained in the semiconductive resin.

According to the present invention, there is also provided a device unit, comprising: a charging member, an electrophotographic photosensitive member, and either one or both of developing means and cleaning means integrally supported together with the charging member and the photosensitive member to form a single unit capable of being attached to or detached from an apparatus body as desired;

the charging member comprising: an electroconductive support, and at least an elastic layer and a surface layer contacting a charge-receiving member disposed on the electroconductive support; and the surface layer comprising at least a semiconductive resin and an insulating metal oxide contained in the semiconductive resin.

According to the present invention, there is further provided an electrophotographic apparatus, comprising: a photosensitive member, a charging member for charging the photosensitive member, means for developing a latent image formed on the photosensitive member to form a developed image, and means for transferring the developed image to a transfer-receiving material;

the charging member comprising: an electroconductive support, and at least an elastic layer and a surface layer contacting a charge-receiving member disposed on the electroconductive support; and the surface layer comprising at least a semiconductive resin and an insulating metal oxide contained in the semiconductive resin.

According to the present invention, there is provided a charging member containing a specific surface layer comprising a semiconductive resin and an insulating meal oxide dispersed in the semiconductive resin, whereby a resistance of the surface layer is increased to prevent occurrence of leakage even if the metal oxide agglomerates or aggregates in the resin.

Due to the insulating metal oxide, the surface layer has an increased film strength and is improved in a withstand voltage characteristic, thus suppressing occurrence of a pinhole of a photosensitive layer of a photosensitive member caused by a dielectric breakdown.

Further, the charging member is effective for providing stable image forming properties due to stable and uniform chargeability because the above specific surface layer suppresses an ununiformity of a resistance and thus ensures a uniform resistance in a nip direction between the charging member and a photosensitive member.

When a surface layer is formed by a semiconductive resin alone, a resultant charging roller fails to provide a durable stability in electric properties because the semiconductive resin is liable to change its electric properties depending upon an environmental condition. In the present invention, such a defect is remedied by dispersing an insulating metal oxide in a surface layer. A charging roller having the surface layer comprising the insulating metal oxide is improved in a durable stability in electric properties.

In addition, the charging member is usable for constituting a device unit and an electrophotographic apparatus providing stable image forming properties in repetitive use.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
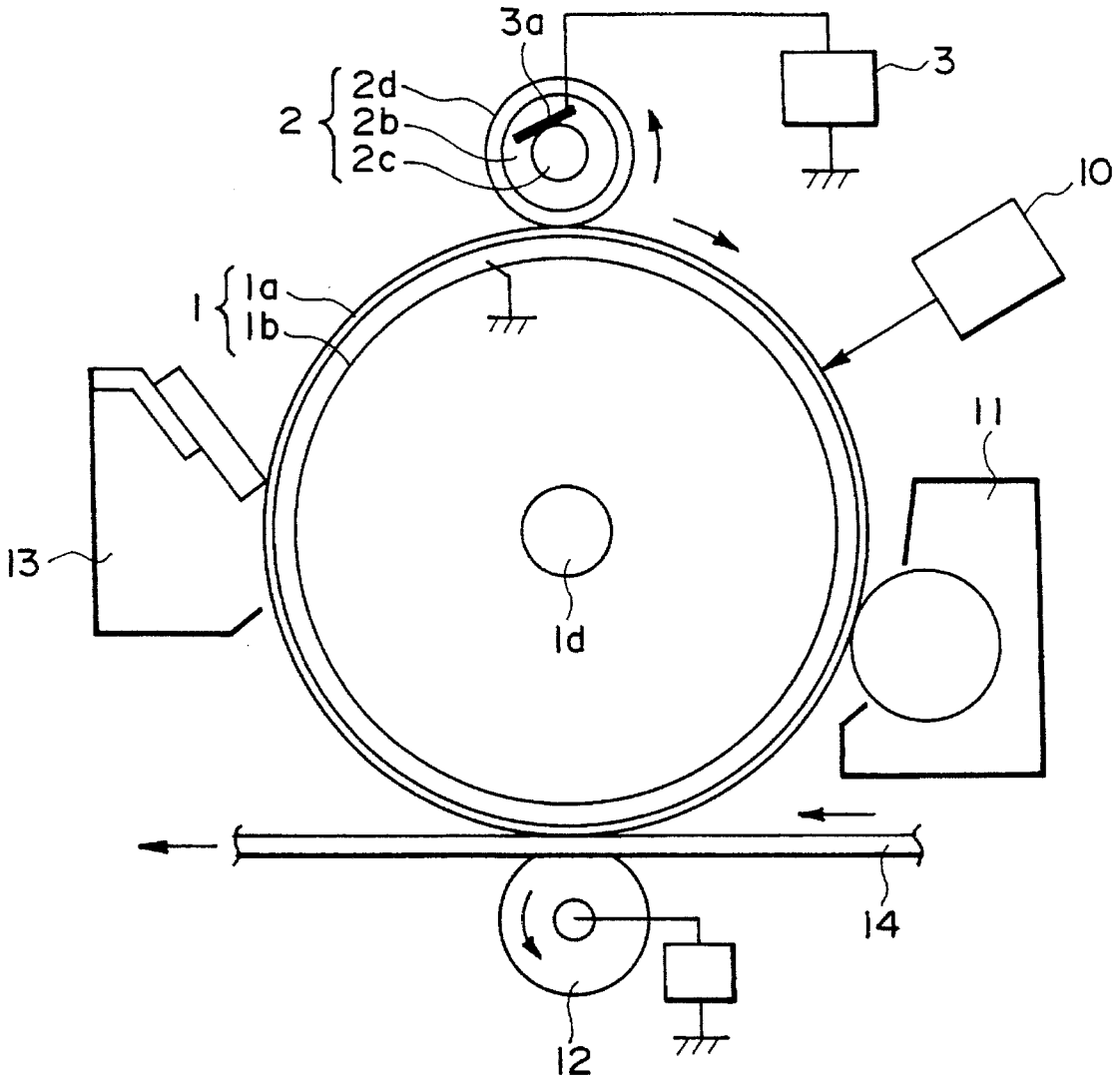
FIG. 1 is a schematic sectional view showing an ordinary electrophotographic apparatus using the charging member according to the present invention.

A charging member according to the present invention is characterized by a specific surface layer comprising a semiconductive resin as a surface resin and an insulating metal oxide contained in the semiconductive resin.

The insulating metal oxide may preferably have a volume resistivity of at least $1\times10^{12}$ ohm.cm, particularly at least $1\times10^{13}$ ohm.cm.

Herein, a volume resistivity of the insulating metal oxide can e measured in the following manner.

In an iron cylinder (inner diameter of 25 mm) having an inner surface treated with a fluorine-containing resin, 10 g of a sample powder (i.e., metal oxide particles) is placed. The sample powder is compressed under a pressure of 100 kg/cm$^2$ (in order to suppress the influence of a resistance of air among particles) by means of a piston disposed within the cylinder. A resistance measuring apparatus is electrically connected to an electrode disposed at a bottom part of the cylinder and an electrode disposed at a top part of the piston (i.e., a face opposite to a face being in contact with the sample powder), whereby a resistance between the two electrodes is measured to obtain a volume resistivity of the sample powder.

This method was applied to semiconductive metal oxide particles and conductive metal oxide particles used in Examples and Comparative Examples appearing hereinafter.

The semiconductive resin may preferably have a volume resistivity of $1\times10^{7}$ ohm.cm to $1\times10^{11}$ ohm.cm, particularly $1\times10^{8}$ ohm.cm to $1\times10^{10}$ ohm.cm, in view of prevention of leakage and image fogs.

Herein, the volume resistivity of the semiconductive resin can be measured according to a resistance-measuring method (ASTM D-257-6.1.10). More specifically, a 50 μm-thick resin layer is formed on an aluminum sheet. A voltage of 100 V is applied to the resin-coated sheet under a temperature of 23° C. and a relative humidity of 50%, thus obtaining a volume resistivity of the resin.

The charging member may preferably have a resistance of $5\times10^{7}$ ohm to $5\times10^{12}$ ohm, particularly $1\times10^{8}$ ohm to $1\times10^{10}$ ohm.

Examples of the insulating metal oxide contained in the semiconductive resin may include: magnesium oxide, zinc oxide, iron oxide, lead oxide, beryllium oxide, cesium oxide, calcium oxide, and zirconium oxide. Among these examples, magnesium oxide may preferably be used.

Examples of the semiconductive resin as a surface resin may include: ionomer (mainly comprising a polymer obtained from ethylene and unsaturated carboxylic acid), polyvinyl alcohol, ethylene-vinyl acetate copolymer, polyurethane elastomer, cellulosic, polyamide, polyvinyl chloride, acrylonitrile-butadiene rubber, chloroprene rubber, acrylic rubber, hydrin rubber, and urethane rubber. Among these examples, the semiconductive resin may preferably comprise polyvinyl alcohol, cellulosics, polyamide and hydrin rubber.

The surface layer of the charging member of the present invention may preferably be prepared by dispersing an insulating metal oxide in a solution of a semiconductive resin in an appropriate solvent to prepare a coating liquid and applying the coating liquid onto an elastic layer by known coating methods such as dipping, spray coating, spinner coating, bead coating, wire bar coating, blade coating, and curtain coating, followed by drying the resultant coating. The surface layer may preferably have a thickness of 5–200 μm. THe surface layer may preferably have a maximum height of surface roughness (Rmax) of at least 10 μm as a lower limit in order to increase a discharge point, thus enhancing a charging efficiency. On the other hand, in view of image forming properties, the surface layer may preferably have an Rmax of at most 100 μm as an upper limit. The surface layer may more preferably have an Rmax of 10–50 μm. Herein, Rmax can be obtained according to Japan Industrial Standard (JIS) B0601 (reference length of 8 mm).

In view of a charging efficiency and image forming properties, the surface layer may preferably comprise 10–150 wt. parts, more preferably 15–100 wt. parts, of the insulating metal oxide on the basis of 100 wt. parts of the semiconductive layer.

In the present invention, the surface layer may further contain an appropriate amount of an additive such as a colorant or a lubricant.

The elastic layer of the charging member of the present invention may preferably have a resistance of $1\times10^{2}$ ohm to $1\times10^5$ ohm. The elastic layer may generally have a thickness of 1–20 mm.

In the present invention, the above-mentioned charging member may suitably be applied to various electrophotographic apparatus.

Hereinbelow, an electrophotographic apparatus using the charging member according to the present invention will be explained.

FIG. 1 is a schematic cross-sectional view of an embodiment of an electrophotographic apparatus including the charging member according to the present invention.

Referring to FIG. 1, a drum-type electrophotographic photosensitive member 1 is used as a charge-receiving member or charge-carrying member and comprises an electroconductive support layer 1*b* such as an aluminum cylinder and a photoconductive layer 1*a* formed on the support layer 1*b*. The photosensitive member 1 is rotated about an axis 1*d* at a prescribed peripheral speed in the clockwise direction. The photosensitive member 1 is uniformly charged by means of a charging member (i.e., charging roller in this embodiment) 2 for performing primary charging or contact charging to have prescribed polarity and potential at the surface thereof. The charging roller 2 comprises a core metal (or a shaft) 2*c* as an electroconductive support, an elastic layer 2*b* and a surface layer 2*d* disposed in this order. THe core metal 2*c* has both end sections at which the core metal is rotatably supported by a bearing member (not shown). The core metal 2*c* is disposed parallel to the axis 1*d*, and the charging roller 2 is caused to abut upon the photosensitive member 1 under a prescribed pressure exerted by a pressing member (not shown) such as a spring, thus rotating mating with the rotation of the photosensitive member 1.

The primary charging or contact charging is performed by applying a DC bias voltage or a superposition of a DC bias voltage and an AC bias voltage to the core metal 2*c* through a friction (or rubbing) electrode 3*a* by means of a power supply 3, thus providing the peripheral surface of the rotating photosensitive member 1 with a prescribed polarity and a prescribed potential.

The peripheral surface of the photosensitive member 1 uniformly charged by the charging member 2 as described above is then subjected to imagewise exposure (e.g., laser beam scanning exposure or slit exposure of an original image) by image exposure means 10, whereby an electrostatic latent image corresponding to original image data is formed on the peripheral surface of the photosensitive member 1. The thus formed latent image is developed or visualized by developing means 11 with a toner to form a toner image (or developed image) in sequence.

The toner image is successively transferred to the front side of a transfer-receiving material 14 such as paper, being timely conveyed from a supply part (not shown) to a transfer position between the photosensitive member 1 and transfer means 12 (i.e., transfer roller in this embodiment) in synchronism with the rotation of the photosensitive member 1, by the transfer means 12. The transfer means (roller) 12 is used for charging the back side of the transfer-receiving material 14 so as to have a polarity opposite to that of the toner, whereby the toner image formed no the photosensitive member 1 is transferred to the front side of the material 14.

Then, the transfer-receiving material 14 having thereon the toner image is detached from the surface of the photosensitive member 1 and is conveyed to fixing means (not shown), thus being subjected to image fixing to be outputted as an image-formed product. Alternatively, the transfer-receiving material 14 is carried to reconveying means for conveying the material 14 back to the transfer position.

The surface of the photosensitive member 1 after the transfer operation is subjected to cleaning by cleaning means 13 for removing and recovering an attached matter, such as a residual toner, from the surface of the photosensitive member 1, thus obtaining a cleaned surface to prepare for the next cycle.

The charging member 2 may include that in the form of a blade, a block, a rod or a belt in addition to the above-mentioned roller-type charging member as shown in FIG. 1. In the present invention, a charging member in the form of a roller or a blade may preferably be used.

In the case of the charging member 2 of the roller-type, the charging member 2 may be rotated mating with movement of a charge-receiving member in the form of, e.g., a sheet or may be one being not rotatable. The charging member 2 may also be rotated for itself at a prescribed peripheral speed in the direction identical to or opposite to the moving direction f the charge-receiving member (e.g., sheet-type) or the rotating direction of the above-mentioned drum-type photosensitive member.

In the present invention, a plurality of elements or components of an electrophotographic apparatus such as the above-mentioned photosensitive member, charging member developing means and cleaning means may be integrally assembled into a device unit, and the device unit may be attachably and detachably disposed in the apparatus body. For example, at least one component selected from a charging member, a charging member, developing means and cleaning means may be integrally assembled together with a photosensitive member into a device unit, and such a device unit is capable of being attached to or detached from the apparatus body by the medium of a guiding means such as rail of the apparatus body. In a preferred embodiment, a charging member and/or developing means may be used together with a photosensitive member to constitute a device unit.

In case where the electrophotographic apparatus is used as a copying machine or printer, image exposure may be effected by using reflection light or transmitted light from an original or by reading a data on the original, converting the data into a signal and then effecting a laser beam scanning, a drive of LEF array or a drive of a liquid crystal shutter array in accordance with the signal.

Figure 2:
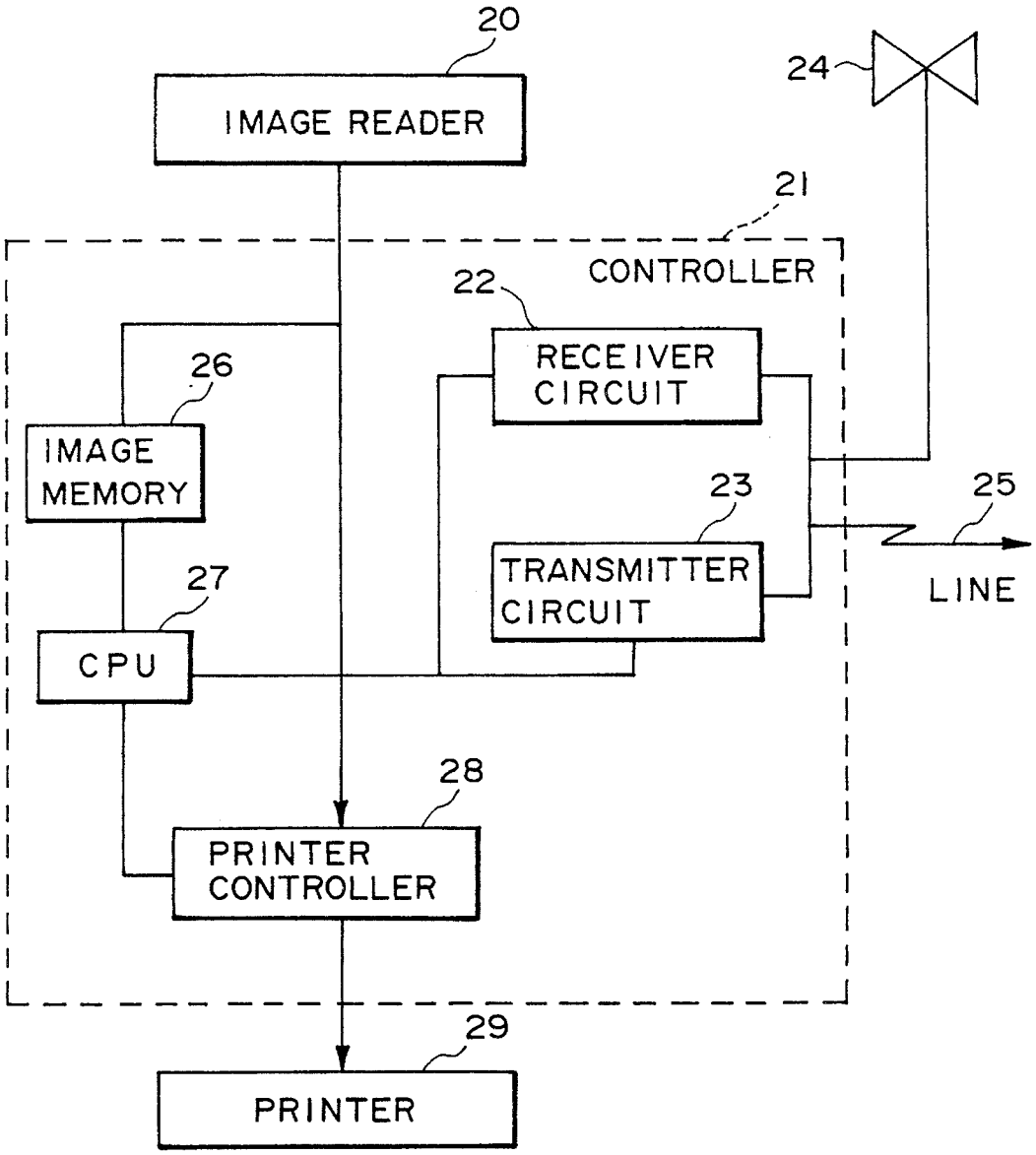
FIG. 2 is a block diagram of a facsimile machine using the electrophotographic apparatus according to the present invention as a printer.

In case where the electrophotographic apparatus including the charging member according to the present invention is used as a printer for facsimile, the above-mentioned image exposure means corresponds to that for printing received data. FIG. 2 shows such an embodiment by using a block diagram.

Referring to FIG. 2, a controller 21 controls an image reader (or image reading unit) 20 and a printer 29. The entirety of the controller 21 is regulated by a CPU (central processing unit) 27. Read data from the image reader 20 is transmitted through a transmitter circuit 23 to another terminal such as facsimile. On the other hand, data received from another terminal such as facsimile is transmitted through a receiver circuit 22 to the printer 29. An image memory 26 stores prescribed image data. A printer controller 28 controls the printer 29. In FIG. 2, reference numeral 24 denotes a telephone system.

More specifically, an image received from a line (or circuit) 25 (i.e., image information received from a remote terminal connected by the line) is demodulated by means of the receiver circuit 22, decoded by the CPU 27, and sequentially stored in the image memory 26. When image data corresponding to at least one page is stored in the image memory 26, image recording is effected with respect to the corresponding page. The CPU 27 reads image data corresponding to one page from the image memory 26, and transmits the decoded data corresponding to one page to the printer controller 28. When the printer controller 28 receives the image data corresponding to one page from the CPU 27, the printer controller 28 controls the printer 29 so that image data recording corresponding to the page is effected. During the recording by the printer 29, the CPU 27 receives another image data corresponding to the next page.

Thus, receiving and recording of an image may be effected by means of the apparatus shown in FIG. 2 in the above-mentioned manner.

Hereinafter, the present invention will be explained in more detail with reference to examples. In the description appearing hereinafter, "parts" means "parts by weight (wt. parts)".

EXAMPLE 1

100 parts of a silicone rubber (trade name: SH831U, manufactured by Toray Dow Corning K.K.) and 7 parts of an electroconductive carbon (Ketjen Black EC, mfd. by K.K. Lion) were melt-kneaded and mold into a roller shape having a diameter of 12 mm and a length of 225 mm wherein an iron shaft (as a core metal (i.e., an electroconductive support) having a diameter of 6 mm was disposed in the center portion, thereby to form an elastic layer on the iron shaft to prepare an electroconductive rubber roller.

The thus prepared rubber roller was subjected to measurement of a resistance as follows.

Figure 3:
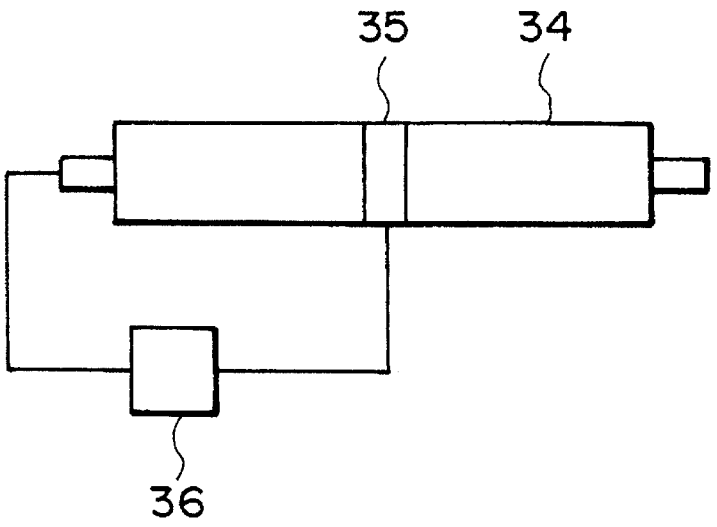
FIG. 3 is an explanatory view for illustrating a method of measuring a resistance of a surface layer of charging rollers used in Examples.

FIG. 3 shows a schematic view for illustrating a method of measuring a resistance of an electroconductive rubber roller and a charging roller used herein. More specifically, referring to FIG. 3, an aluminum foil 35 having a width of 10 mm is wound on a rubber roller (or a charging roller) 34. A direct-current (DC) voltage of 250 V is applied between a core metal and the aluminum foil 35, followed by current measurement to obtain a resistance.

The rubber roller showed a resistance of $5\times10^4$ ohm under an environmental condition of a temperature of 23° C. and a relative humidity of 55%.

Then, a surface layer was prepared in the following manner.

714 parts of a solution (solid content of 14 wt. %) of methoxymethylated nylon (Toresin EF30T, mfd. by Teikoku Kagaku Sangyo K.K.; volume resistivity of $1\times10^9$ ohm.cm) in a mixture solvent of methanol/toluene, and 70 parts of insulating magnesium oxide (MgO) (Kyowa Mag 20, mfd. by Kyowa Kagaku Kogyo K.K.; volume resistivity of $1\times10^{14}$ ohm.cm, particle size: 150 μm-opening sieve passing rate of 100% and 75 μm-opening sieve passing rate of 99.7%) were stirred for 15 minutes by a sand mill to prepare a coating liquid. The coating liquid was applied onto the above-prepared rubber roller by dipping and dried at 120° C. for 2 hours to form a 20 μm-thick surface layer, whereby a charging roller (i.e., a charging member) of the present invention was prepared.

The semiconductive resin had a maximum surface roughness (Rmax) of 18 μm.

The charging roller showed a resistance of $1.5\times10^9$ ohm under an environmental condition of a temperature of 15° C. and a relative humidity of 10%.

Then, the thus-prepared charging roller was assembled in a cartridge (EP-L cartridge, mfd. by Canon K.K.) to prepare a device unit. The device unit was further assembled in a laser beam printer (Laser SHot A404, mfd. by Canon K.K.) as an electrophotographic apparatus and then subjected to image formation of 3500 sheets (a durability test) under an environmental condition of a temperature 15° C. and a relative humidity of 10%. The results are shown in Table 1 appearing hereinbelow.

As apparent from the results shown in Table 1, the electrophotographic apparatus including the charging roller according to the present invention provided stable image forming properties causing no black spots and black streaks from an initial stage to a stage after 3500 sheets copying, thus ensuring a stable and uniform charging.

Figure 4:
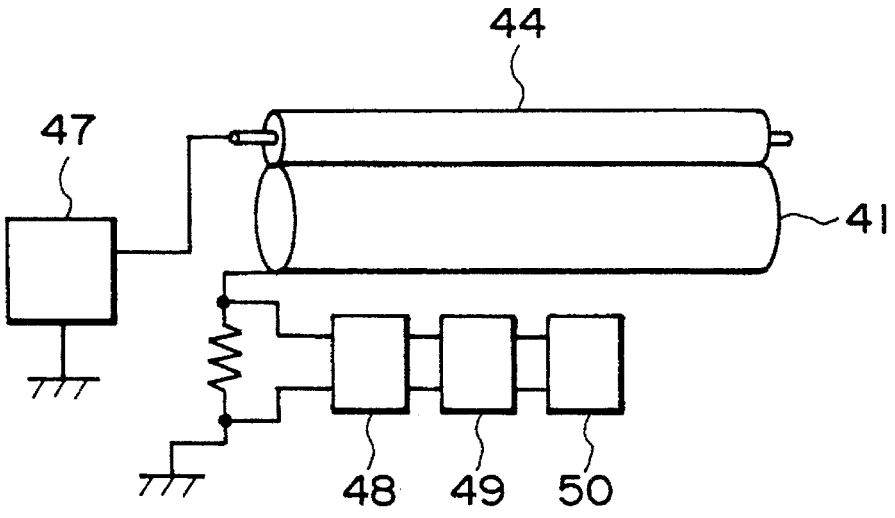
FIG. 4 is an explanatory view for illustrating a withstand voltage-measuring apparatus for charging rollers used in Examples.

Further, the above-mentioned charging roller was subjected to measurement of a withstand voltage (a withstand voltage test) by using a withstand voltage-measuring apparatus as shown in FIG. 4 in the following manner.

Referring to FIG. 4, in the measuring apparatus, a charging roller 44 is rotated while being in contact with a metal drum 41. The charging roller 44 includes a core metal having both end parts each under a load of 500 gf to be exerted on the metal drum 41. The core metal of the charging roller 44 is electrically connected to a high-voltage power supply 47. On the other hand, the metal drum is electrically connected to a recorder 50 through the media of a low pass filter 48 and a digital multimeter 49.

By using the measuring apparatus, a DC voltage was applied to the above-prepared charging roller from −500 V to −2000 V under an environmental condition of a temperature of 23° C. and a relative humidity of 55%. As a result, no leakage was observed under the voltage application of −2000 V, thus showing a good withstand voltage characteristic.

For comparison, a comparative charging roller having a 20 μm-thick surface layer was prepared in the same manner as in the charging roller mentioned above except that the insulating magnesium oxide (MgO) was omitted from the coating liquid for the surface layer. The thus prepared comparative charging roller was evaluated in the same manner as in the charging roller mentioned above according to the present invention. As a result, after 3500 sheets of copying (durability test), black streaks due to charging failure were caused to occur in a resultant sheet.

EXAMPLE 2

A charging roller having a 20 μm-thick surface layer was prepared in the same manner as in Example 1 except that 100 parts of insulating zinc oxide (ZnO) (Zinc Oxide No. 1, mfd. by Hakusui Kagaku K.K.; volume resistivity of $1\times10^{15}$ ohm.cm) was used instead of the MgO used in Example 1.

The charging roller was evaluated in the same manner as in Example 1. The results are also shown in Table 1 appearing hereinbelow.

Similarly as in Example 1, the charging roller of this embodiment provided stable image forming properties (in other words, stable and uniform charging properties) from an initial stage to a stage after 3500 sheets of copying, and also caused no leakage, thus showing a good withstand voltage characteristic.

COMPARATIVE EXAMPLE 1

A charging roller having a 20 μm-thick surface layer was prepared in the same manner as in Example 1 except that electroconductive titanium oxide ($TiO_2$) (ET500W, mfd. by Ishihara Sangyo K.K.; volume resistivity of 4 ohm.cm) was used instead of the MgO used in Example 1.

The charging roller was evaluated in the same manner as in Example 1. The results are shown in Table 1.

At a stage after 1000 sheets copying, an electrophotographic apparatus including the charging roller provided black spots, thus showing image failure. Further, in a withstand voltage test, leakage was caused to occur (i.e., a leakage current (overcurrent) was observed) at an applied voltage of −700 V, thus showing a poor withstand voltage characteristic.

COMPARATIVE EXAMPLE 2

A charging roller having a 20 μm-thick surface layer was prepared in the same manner as in Example 1 except that electroconductive tin oxide (T-1, mfd. by Mitsubishi Material K.K.; volume resistivity of 2 ohm.cm) was used instead of the MgO used in Example 1.

The charging roller was subjected to measurement of a resistance in the same manner and the same condition as in Example 1 and then subjected to image formation. As a result, a resistance of the charging roller was not uniform in the nip direction, and black streaks due to leakage and black spots due to a dielectric breakdown were caused to occur under an environmental condition of a temperature of 32.5° C. and a relative humidity of 85%.

EXAMPLE 3

A charging roller having a 20 μm-thick surface layer was prepared in the same manner as in Example 1 except that the stirring time (15 minuets) of the coating liquid for the surface layer was changed to 60 minutes.

At this time, a resultant surface layer had an Rmax of 10 μm.

The charging roller was evaluated in the same manner as in Example 1. The results are shown in Table 1.

EXAMPLE 4

A charging roller having a 2 μm-thick surface layer was prepared in the same manner as in Example 1 except that a coating liquid for a surface layer was prepared through a stirring for 5 minutes by means of a stirrer.

At this time, the surface layer had an Rmax of 100 μm.

The charging roller was evaluated in the same manner as in Example 1. The results are shown in Table 1 below.

EXAMPLE 5

A charging roller having a 20 μm-thick surface layer was prepared in the same manner as in Example 1 except that an aqueous solution of 15 wt. % of polyvinyl alcohol (Gosenol GM-14, mid. by Nippon Gosei Kagaku K.K.; saponification degree of 86.5–89.0 mol. %, polymerization degree of 1000–1500, volume resistivity of $2\times10^9$ ohm.cm) was used instead of the methoxymethylated nylon solution (solid content of 14 wt. %) used in Example 1.

The charging roller had an Rmax of 25 μm.

The charging roller was subjected to measurement of a resistance in the same manner and the same condition as in Example 1 and also subjected to image formation for evaluating image forming properties at an initial stage. As a result, the charging roller showed a uniform resistance ($2.5\times10^9$ ohm.cm) in the nip direction and also provided stable and good images free from black spots and black streaks. When the charging roller was further subjected to a durability test in the same manner as in Example 1, no image failure was caused to occur.

EXAMPLE 6

A charging roller having a 20 μm-thick surface layer was prepared in the same manner as in Example 1 except that a solution (solid content of 8 wt. %) of methylcellulose (volume resistivity of $3\times10^{10}$ ohm.cm, ether degree of 45%) in a mixture solvent of toluene/xylene (=3/1) was used instead of the methoxymethylated nylon solution (solid content of 14 wt. %) used in Example 1.

The charging roller had an Rmax of 29 μm.

The charging roller was subjected to measurement of a resistance ($3.5\times10^{10}$ ohm) in the same manner and the same condition as in Example 1 and also subjected to image formation for evaluating image forming properties at an initial stage. As a result, the charging roller showed a uniform resistance ($2.5\times10^9$ ohm.cm) in the nip direction and also provided stable and good images free from black spots and black streaks. When the charging roller was further subjected to a durability test in the same manner as in Example 1, no image failure was caused to occur.

What is claimed is:

1. A charging member for use in a contact charging device which charges a charge-receiving member by applying a voltage to the charging member and disposing the charging member in contact with the charge-receiving member, comprising:

TABLE 1

| | Metal oxide | | | | Image evaluation*1,*2 | | | | |
|---|---|---|---|---|---|---|---|---|---|
| Ex. No. | Material | Amount (parts) | $R_{max}$ (μm) | Resistance*1 (ohm) | Initial | After 1000 sheets | After 1500 sheets | After 3500 sheets | Withstand*3 voltage (V) |
| Ex. 1 | MgO | 70 | 18 | $1.5\times10^9$ | ○ | ○ | ○ | ○ | −2000 or above |
| Ex. 2 | ZnO | 100 | 22 | $2.0\times10^9$ | ○ | ○ | ○ | ○ | " |
| Comp. Ex. 1 | TiO (conductive) | 70 | 13 | $4.0\times10^6$ | ○ | x | x | x | below −700 |
| Ex. 3 | MgO | 70 | 10 | $5.0\times10^8$ | ○ | ○ | ○ | Δ | −2000 or above |
| Ex. 4 | MgO | 70 | 100 | $2.0\times10^9$ | ○ | ○ | Δ | Δ | " |

*1: Measured at 15° C. and 10% RH.
*2: ○: No black spots and black streaks occurred. Δ: Acceptable black spots and black streaks occurred. x: Inacceptable black spots and black streaks occurred.
*3: Measured at 23° C. and 55% RH.

at least an elastic layer and a surface layer disposed thereon contacting the charge-receiving member, the surface layer comprising at least a semiconductive resin and an insulating metal oxide contained in the semiconductive resin, and the surface layer having a maximum height of surface roughness (Rmax) of 10 μm to 100 μm.

2. A member according to claim 1, wherein the insulating metal oxide has a volume resistivity of at least $1\times10^{12}$ ohm.cm.

3. A member according to claim 1 or 2, wherein the semiconductive resin has a volume resistivity of $1\times10^{7}$ ohm.cm to $1\times10^{11}$ ohm.cm.

4. A member according to claim 1 or 2, wherein the semiconductive resin has a volume resistivity of $1\times10^{8}$ ohm.cm to $1\times10^{10}$ ohm.cm.

5. A charging member according to claim 1, wherein the surface layer comprises 10–150 wt. parts of the insulating metal oxide on the basis of 100 wt. parts of the semiconductive resin.

6. A member according to claim 1, wherein the elastic layer has a resistance of $1\times10^{2}$ ohm to $1\times10^{5}$ ohm.

7. A member according to claim 2, wherein the insulating metal oxide is magnesium oxide.

8. A member according to claim 1, wherein the semiconductive resin is polyamide.

9. A member according to claim 2, wherein the insulating metal oxide is zinc oxide.

10. A device unit, comprising: a charging member, an electrophotographic photosensitive member, and either one or both of developing means and cleaning means integrally supported together with the charging member and the photosensitive member to form a single unit capable of being attached to or detached from an apparatus body as desired;

the charging member comprising: an electroconductive support, and at least an elastic layer and a surface layer contacting a charge-receiving member disposed on the electroconductive support;

wherein the surface layer comprises at least a semiconductive resin and an insulating metal oxide contained in the semiconductive resin, and wherein the surface layer has a maximum height of surface roughness (Rmax) of 10 μm to 100 μm.

11. A unit according to claim 10, wherein the insulating metal oxide has a volume resistivity of at least $1\times10^{12}$ ohm.cm.

12. A unit according to claim 10 or 11, wherein the semiconductive resin has a volume resistivity of $1\times10^{7}$ ohm.cm to $1\times10^{11}$ ohm.cm.

13. A unit according to claim 11, wherein the insulating metal oxide comprises either one or both of magnesium oxide and zinc oxide.

14. A device unit according to claim 10, wherein the surface layer comprises 10–150 wt. parts of the insulating metal oxide on the basis of 100 wt. parts of the semiconductive resin.

15. An electrophotographic apparatus, comprising: a photosensitive member, a charging member for charging the photosensitive member, means for developing a latent image formed on the photosensitive member to form a developed image, and means for transferring the developed image to a transfer-receiving material;

the charging member comprising: an electroconductive support, and at least an elastic layer and a surface layer contacting a charge-receiving member disposed on the electroconductive support;

wherein the surface layer comprises at least a semiconductive resin and an insulating metal oxide contained in the semiconductive resin, and wherein the surface layer has a maximum height of surface roughness (Rmax) of 10 μm to 100 μm.

16. An apparatus according to claim 15, wherein the insulating metal oxide has a volume resistivity of at least $1\times10^{12}$ ohm.cm.

17. An apparatus according to claim 15 or 16, wherein the semiconductive resin has a volume resistivity of $1\times10^{7}$ ohm.cm to $1\times10^{11}$ ohm.cm.

18. An apparatus according to claim 16, wherein the insulating metal oxide comprises either one or both of magnesium oxide and zinc oxide.

19. An apparatus according to claim 15, wherein the surface layer comprises 10–150 wt. parts of the insulating metal oxide on the basis of 100 wt. parts of the semiconductive resin.

* * * * *

UNITED STATES PATENT AND TRADEMARK OFFICE

CERTIFICATE OF CORRECTION

PATENT NO. : 5,502,548

DATED : March 26, 1996

INVENTORS : Yasuyuki Suzuki, et al.

It is certified that error appears in the above-identified patent and that said Letters Patent is hereby corrected as shown below:

COLUMN 1

Line 55, "na" should read --an--.

COLUMN 2

Line 4, "cause" should read --caused--;
Line 7, "fogs" should read --fog--; and
Line 65, "meal" should read --metal--.

COLUMN 3

Line 60, "e" should read --be--.

COLUMN 4

Line 13, "fogs." should read --fog.--; and
Line 48, "THe" should read --The--.

COLUMN 5

Line 26, "THe" should read --The--; and
Line 61, "no" should read --on--.

UNITED STATES PATENT AND TRADEMARK OFFICE

CERTIFICATE OF CORRECTION

PATENT NO. : 5,502,548

DATED : March 26, 1996

INVENTORS : Yasuyuki Suzuki, et al.

It is certified that error appears in the above-identified patent and that said Letters Patent is hereby corrected as shown below:

COLUMN 8

Line 4, "SHot" should read --Shot--.

COLUMN 9

Table 1, "Inacceptable" should read --Unacceptable--.

COLUMN 10

Line 5, "mid." should read --mfd.--.

Signed and Sealed this

Twenty-seventh Day of August, 1996

Bruce Lehman

*Attest:*

BRUCE LEHMAN

*Attesting Officer*

*Commissioner of Patents and Trademarks*